US005569131A

United States Patent [19]

Giulianelli

[11] Patent Number: 5,569,131

[45] Date of Patent: Oct. 29, 1996

[54] CHILD'S HOPPING TOY

[76] Inventor: Jo. Anne Giulianelli, 635 Downing Ct., Erie, Pa. 16502

[21] Appl. No.: 562,700

[22] Filed: Nov. 27, 1995

[51] Int. Cl.[6] ..... A63H 7/00

[52] U.S. Cl. ..... 482/77; 446/26; 446/226; 446/268; 446/486; 472/135

[58] Field of Search ..... 482/30, 77; 472/14, 472/15, 27, 133, 135

[56] References Cited

U.S. PATENT DOCUMENTS

| | | | |
|---|---|---|---|
| D. 249,379 | 9/1978 | Barton et al. | D34/15 B |
| 2,242,748 | 5/1941 | Fulwiler | 482/77 |
| 2,884,247 | 4/1959 | Johns | 482/77 |
| 3,195,890 | 7/1965 | Salls | 482/77 |
| 3,427,019 | 2/1969 | Brown | 482/77 |
| 3,462,113 | 8/1969 | MacLeod | 472/135 |
| 3,886,607 | 6/1975 | Dunn | 472/135 |
| 4,429,693 | 2/1984 | Blake et al. . | |
| 4,438,919 | 3/1984 | Gamzo | 472/135 |
| 4,912,859 | 4/1990 | Ritts | 482/77 |
| 5,074,619 | 12/1991 | D'Orsi et al. | 297/236 |

FOREIGN PATENT DOCUMENTS

| | | | |
|---|---|---|---|
| 1166856 | 10/1969 | United Kingdom | 472/15 |

OTHER PUBLICATIONS

Wahignton Post, Sep. 10, 1971, p. d16.

*Primary Examiner*—Robert A. Hafer
*Assistant Examiner*—Jeffrey D. Carlson
*Attorney, Agent, or Firm*—Lovercheck and Lovercheck

[57] ABSTRACT

A hopping toy made up of a platform, a base, a spring supporting the platform on the base and a sack having an open top and an open bottom. A ring is attached to the open top. An inflatable animal-like figure is supported on the top of the sack. A child may stand in the sack on the platform in front of the animal-like figure and hop with the base engaging the ground.

2 Claims, 2 Drawing Sheets

CHILD'S HOPPING TOY

BACKGROUND OF THE INVENTION

This invention relates to games and more particularly to an improved hopping game wherein the invention is a toy which incorporates a sack. The toy is an improvement on the traditional sack race game. The inflated figure of an animal is attached to the sack and the sack extends down around a platform on which a child may stand. The sack is attached to the platform and encloses the platform. The platform is supported on helical springs which are in turn, supported on a base. The child standing on the platform uses the hopping toy.

The toy is in the form of a kangaroo especially suited for children ages six through ten. The inflated upper part of the body of an animal is supported on the upper part of the sack and a hula-hoop like ring is received in the upper part of the sack between two layers of plastic sheet. The head, back and arms of the animal may be inflated from the waist up, or could be filled with foam plastic. The center could have a circular plastic tube inserted (like a hula-hoop) so that the child can hold onto the circular plastic when hopping. The nose should be red and made to squeak. The height of the toy should be at least three and one-half feet to four feet high, but a larger toy can be made that is four and one-half feet high.

The platform could be one inch thick light weight plastic (like a Frisbee) strong enough for a child to stand on. The platform has two sets of elastic bands attached by grooves. One band receives the back part of the foot and ankle, and the other receiving the front part of the foot. Four spaced slots which are provided at the front, back and sides of the platform to receive the straps for fastening the sack to the platform. The platform should be at least eight to ten inches in diameter. A helical spring is attached to the bottom of the platform. The child slips his shoes under the bands and proceeds to hop.

The platform can also be used separately for children ages eleven to thirteen to hop with. The animal body on the toy can be interchangeable with other designs, such as rocky rabbit, sandy snake or numerous other designs.

Applicant is aware of the following U.S. Pat. Nos.: DES 249,379; DES 295,988; 4,185,819; 4,291,488 and 5,074,619.

SUMMARY OF THE INVENTION

It is an object of the present invention to provide an improved hopping toy.

It is another object of the present invention to provide a child's hopping toy that is simple in construction, economical to manufacture, simple and efficient to use, extremely interesting and useful for child to play with.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
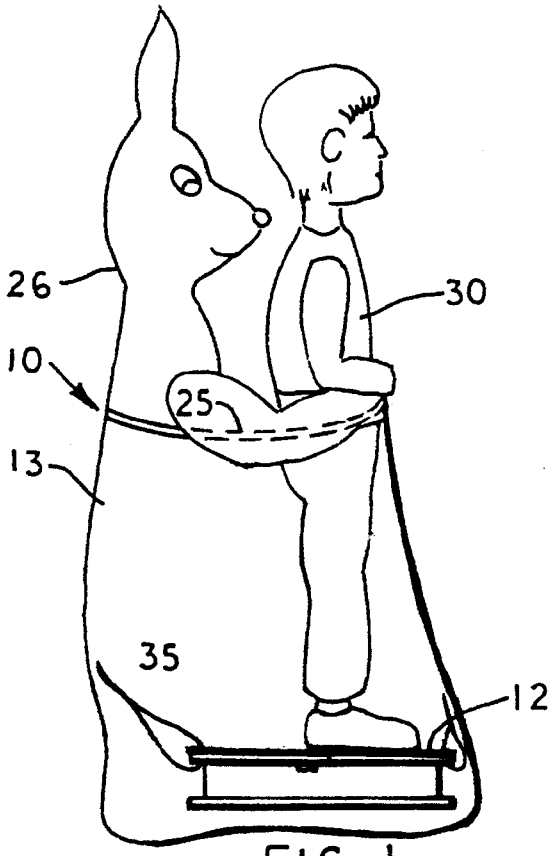
FIG. 1 is a side view of the toy according to the invention with one side of the sack removed.

Now with more particular reference to the drawings, child's hopping toy 10 comprises a platform 12, sack 25, helical spring 14 between platform 12 and base 16.

Figure 5:
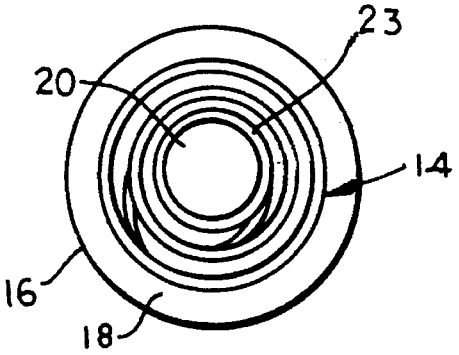
FIG. 5 is a top view of the toy with the animal and platform removed.
Figure 6:
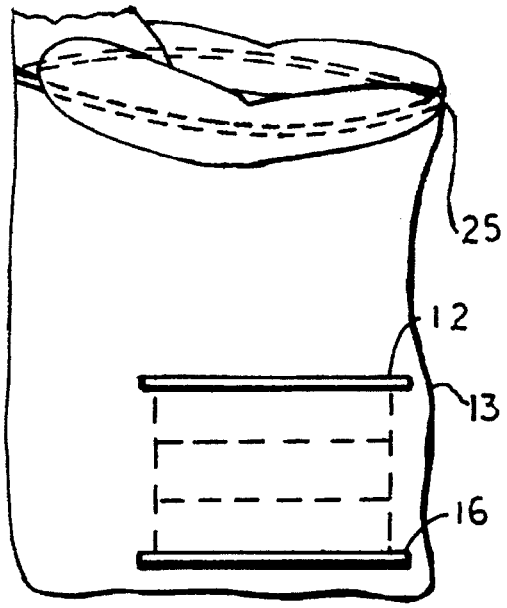
FIG. 6 is a side view of the platform base with the animal head removed.
Figure 7:
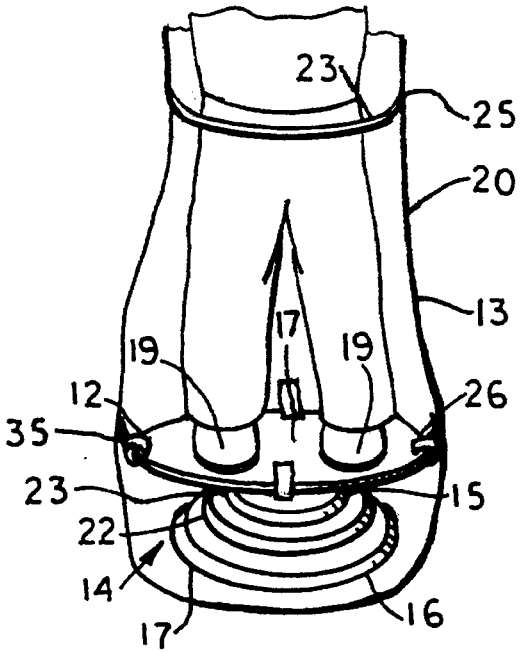
FIG. 7 is a partial isometric view of the toy with the front part of the sack removed.
Figure 8:
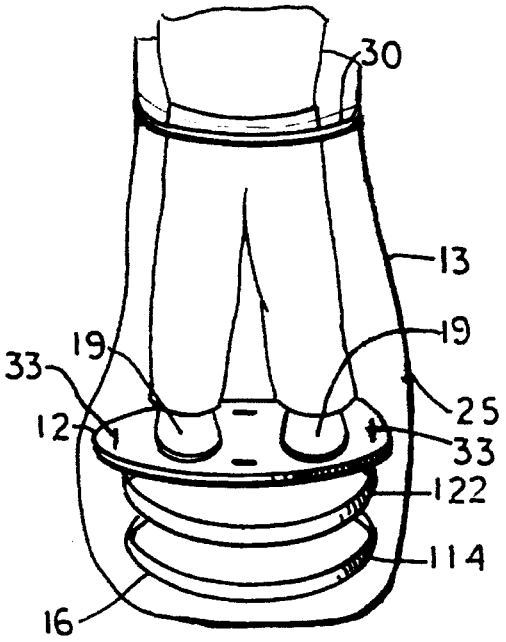
FIG. 8 is a partial isometric view of the platform and base with part of the sack removed.

Helical spring 14 has upper turn 15 attached to platform 12 and lower turn 17 attached to base 16 and a plurality of turns 22 disposed between platform 12 and base 16. Turns 22 of helical spring 14 may be of substantially equal diameter, as shown in FIG. 8, or they may be of a smaller diameter at the upper end where they are attached to platform 12. As shown in FIGS. 5 and 7 turns 22 may be of decreasing diameter from base 16 to the under side of platform 12 and upper turn 15 is fixed to the bottom of platform 12 and lower turn 17 of helical spring 14 is fixed to base 16 by means familiar to those skilled in the art. Spaced slots 33 are provided in platform 12 which receive straps 35. The straps 35 are attached to sack 25. Platform 12 can be made like a large "Frisbee".

Sack 25 may be made of two ply plastic material with three ply plastic material bottom and with an open top. The open top may be attached to a hula-hoop like ring and having a large enough diameter to freely receive child 30 and can be held in the child's hand to support sack 25 while hopping.

Figure 2:
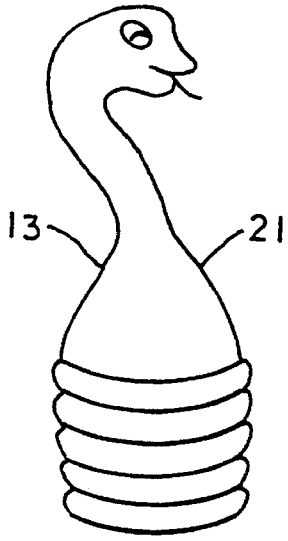
FIG. 2 is a side view of an inflatable animal that could be used as another form of the invention.
Figure 3:
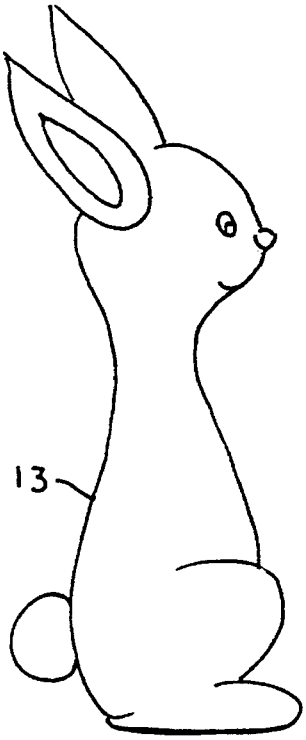
FIG. 3 is a side view of another form of an animal that could be used with the base shown in FIG. 1.
Figure 4:
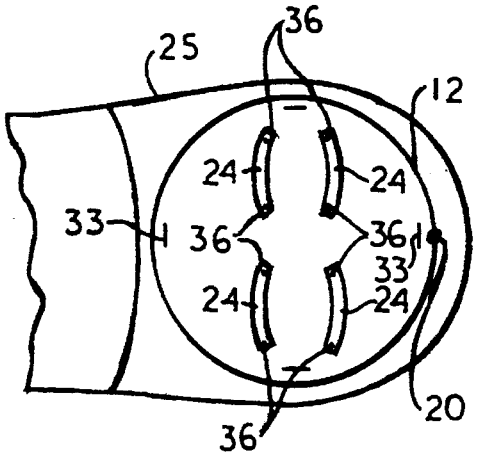
FIG. 4 is a top view of the platform with the animal sack removed.

Head 26 and part of the sack 25 are plastic. Animal body 13 may be in the form of a kangaroo, as shown in FIG. 1, snake as shown in FIG. 2, or rabbit shown in FIG. 3, or any other desired figure. The height of animal's sack 25 should be about three and one half feet for small children and about four and one half feet for larger children.

Sack 25 is attached to platform 12 by straps 35. The child slips into the open top of sack 25 and places his or her feet inside. Feet 19 are placed into the space below straps 24 that are attached to the top of platform 12 at 36. Child 30 then pulls the ring 23 upward thereby pulling sack 25 up to his or her waist. The animal head and shoulders are raised by sack 25 to a position about the child's waist. Then, child 30 proceeds to hop.

The foregoing specification sets forth the invention in its preferred, practical forms but the structure shown is capable of modification within a range of equivalents without departing from the invention which is to be understood is broadly novel as is commensurate with the appended claims.

I claim:

1. A child's hopping toy comprising a platform, a base and a resilient means for resiliently spacing apart said platform and said base;

a sack having an open top;

said sack being sized so that a child may sand inside with said open top reaching the waist of a child;

a means for attaching said sack to said platform;

a ring, like a hula-hoop is attached to said open top of said sack for a child to hold onto while hopping;

a part of an inflated animal like body is attached to said sack and supported on said platform providing a space for a child to stand on said platform in said ring in front of said animal-like body;

the animal like body has arms that extend forwardly along the circumference of the ring, providing protection for a child and providing stability for a child.

2. The toy recited in claim 1 wherein said animal like body is in the form of a kangaroo.

* * * * *